US005692887A

United States Patent [19]

Krueger et al.

[11] Patent Number: 5,692,887

[45] Date of Patent: Dec. 2, 1997

[54] FIXED VANE ROTARY COMPRESSOR

[75] Inventors: Manfred Krueger; Rinaldo Puff, both of Joinville, Brazil

[73] Assignee: Empresa Brasileira de Compressores S/A-Embraco, Joinville, Brazil

[21] Appl. No.: 586,653

[22] PCT Filed: Jun. 29, 1994

[86] PCT No.: PCT/BR94/00020

§ 371 Date: Apr. 3, 1996

§ 102(e) Date: Apr. 3, 1996

[87] PCT Pub. No.: WO95/01509

PCT Pub. Date: Jan. 12, 1995

[30] Foreign Application Priority Data

Jun. 30, 1993 [BR] Brazil ..... 9302314

[51] Int. Cl.[6] ..... F04C 18/324

[52] U.S. Cl. ..... 418/67

[58] Field of Search ..... 418/67

[56] References Cited

U.S. PATENT DOCUMENTS

| | | | |
|---|---|---|---|
| 2,344,159 | 3/1944 | Meeks | 418/67 |
| 2,929,550 | 3/1960 | Sadler | 418/67 |
| 3,554,676 | 1/1971 | Porteous | 418/63 |

FOREIGN PATENT DOCUMENTS

| | | | |
|---|---|---|---|
| 923927 | 7/1947 | France . | |
| 17 51 224 | 6/1971 | Germany . | |
| 3100391 | 4/1991 | Japan | 418/67 |
| 227330 | 2/1925 | United Kingdom . | |

*Primary Examiner*—John J. Vrablik

*Attorney, Agent, or Firm*—Darby & Darby

[57] ABSTRACT

A rotary compressor having a cylinder within which an eccentric piston is rotated. A vane has one end mounted in a radial slot in the cylinder and an insert is mounted in the other end of the vane. The insert has a concave face to contact the outer surface of the piston as it rotates and an engaging element in the form of a key lodged in slots in the insert and the piston, acts simultaneously on the piston and insert and restrains the piston from rotating.

5 Claims, 3 Drawing Sheets

FIXED VANE ROTARY COMPRESSOR

FIELD OF THE INVENTION

The present invention refers to a rotary compressor presenting a fixed vane and, more particularly, to a new construction for the piston-vane assembly of this type of compressor, in which the piston performs a circular translational motion inside the cylinder.

BACKGROUND OF THE INVENTION

In rotary hermetic compressors with a fixed vane, the separation inside the cylinder between a high pressure, or discharge, chamber and a low pressure or suction chamber occurs according to a contact line between the rolling piston and the cylinder and between the rolling piston and the fixed vane, as the top of said vane follows the displacement of the rolling piston when said top is forced against the external surface of said piston, by the action of an impelling means, such as a spring.

Also due to the high pressure differential existing between the internal part of the compressor case (which is maintained at a high discharge pressure of the system) and the inside of the cylinder, which is maintained at a lower pressure during most of the compression cycle, the fixed vane is forced against the external surface of the rolling piston. The action of said forces, together with the shape of the vane top causes, between the rolling piston and the fixed vane, a limit lubrication, i.e., an intermediate phase between the formation of a hydrodynamic wedge and the metallic contact between the parts. As a result, such lubrication becomes insufficient, allowing the metallic contact between the parts, causing wear on the top of the fixed vane and on the external contact surface of the rolling piston, resulting in alterations on the diameter of said piston, impairing its useful life and consequently affecting the reliability of the compressor.

Such contact, besides generating friction noise, which is difficult to attenuate, increases the energy loss of the compressor, thus impairing its efficiency. Moreover, the profile of the contact between the rolling piston and the fixed vane causes leakages between the compression and suction chambers of the compressor, reducing the volumetric capacity of said compressor.

The known solutions to minimize the problem of wear between the rolling piston and fixed vane make use of materials that are more resistant to wear in the manufacture of fixed vanes. Compound materials may also be used, which, besides high durability, present the advantages of low specific weight and low friction coefficient. Nevertheless, the solution that uses special materials to construct the contact parts, such as the one described in the Brazilian Patent Application PI 9102901 of the same applicant, in which the fixed vane is provided at the free end thereof with an insert, which is designed to contact the rolling piston and is made of a material that is more resistant to wear, increases the cost of the compressor, due to the high costs of said materials.

These solutions, although reducing the problem of wear in the vane and rolling piston, do not minimize the problems of noise and energetic loss of the compressor.

DISCLOSURE OF THE INVENTION

Thus, it is a general object of the present invention to reduce the metallic contact and the wear between the top of the vane and the external surface of the piston of a rotary compressor, without causing losses in the energy efficiency of the compressor.

Another object of the present invention is to present a solution to the above cited problem, which does not require the use of special materials for constructing the contact parts presenting relative movement to each other, without altering the normal running conditions of the compressor.

It is also a specific object of the present invention to present a vane-piston assembly, which allows the formation of a permanent sealing oil film between the contact surfaces of said vane and piston, thereby minimizing the leakages between the compression and suction chambers of the compressor, besides reducing the friction noises.

The rotary compressor used in the present invention is of the type including a piston, driven by an eccentric shaft, which performs a circular translational movement along the internal surface of a cylinder, which has a radial slot, for holding a fixed vane, whose free end presents a curved surface in permanent contact with the lateral surface of the piston. At least part of the peripheral extension of the lateral surface of the piston has a contour with a curvature that is substantially equal and concentric relative to the curvature of the contact end surface of said vane. Engaging means are provided to act on the piston and on the fixed vane, in order to restrain said piston from effecting a rotary motion around its axis, allowing that only a certain contact portion of the peripheral extension of the lateral surface of the piston presenting said curvature maintains contact with the contact end surface of said fixed vane, when the piston oscillates to both sides of a diametral plane containing the radial slot of the cylinder and around the contact end surface of said vane during the translational movement of said piston.

With this new construction solution, there is achieved a substantial reduction in the intermittent metallic contact of the fixed vane with the external surface of the piston, minimizing the wear and the noise caused by said contact during the compressor operation, due to the provision of a permanent oil film between the contact surfaces of the fixed vane and piston, consequently increasing the efficiency and reliability of the compressor.

BRIEF DESCRIPTION OF THE DRAWINGS

The invention will be described below, with reference to the attached drawings, in which.

BEST WAY OF CARRYING OUT THE INVENTION

Figure 1:
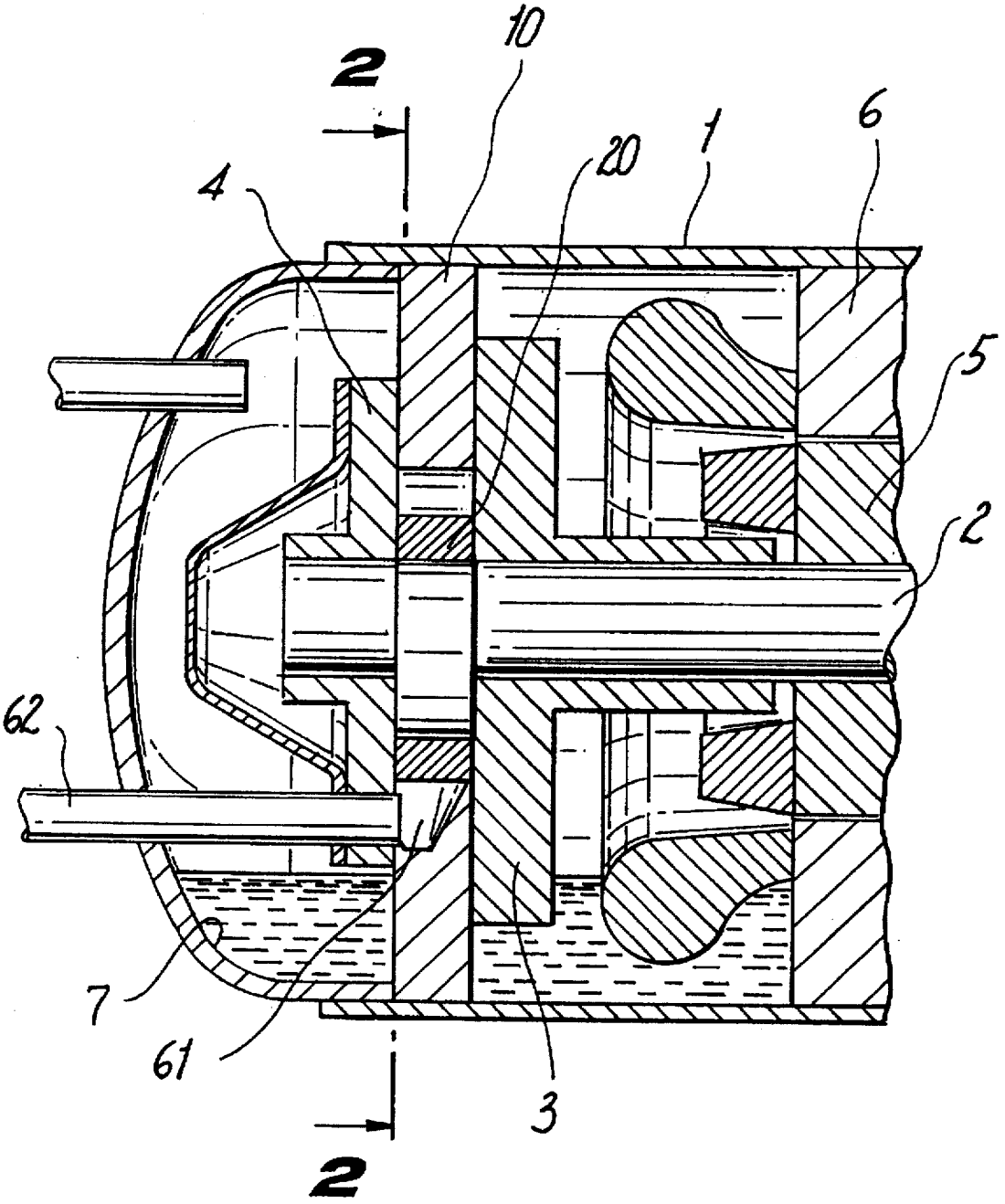
FIG. 1 illustrates a partial longitudinal vertical sectional view of a rotary hermetic compressor, incorporating a fixed vane of the type used in the present invention.

According to the illustrations cited above, the rotary hermetic compressor comprises a cylindrical case 1, within which a cylinder 10 is rigidly fastened and lodges a piston 20, driven by an eccentric shaft 2, which is supported by a main bearing 3 and by a secondary bearing 4.

The eccentric shaft 2 is driven by a rotor 5 of an electric motor, whose stator 6 is attached against the internal wall of the case 1.

The cylinder 10 is provided with a radial slot 11, in which there is lodged a fixed vane 30, that is constantly biased by a spring 40 to a permanent contact position of the vane free end 31 on the lateral surface 21 of the piston 20, during the reciprocating motion of said vane inside said radial sliding slot 11.

Figure 2:
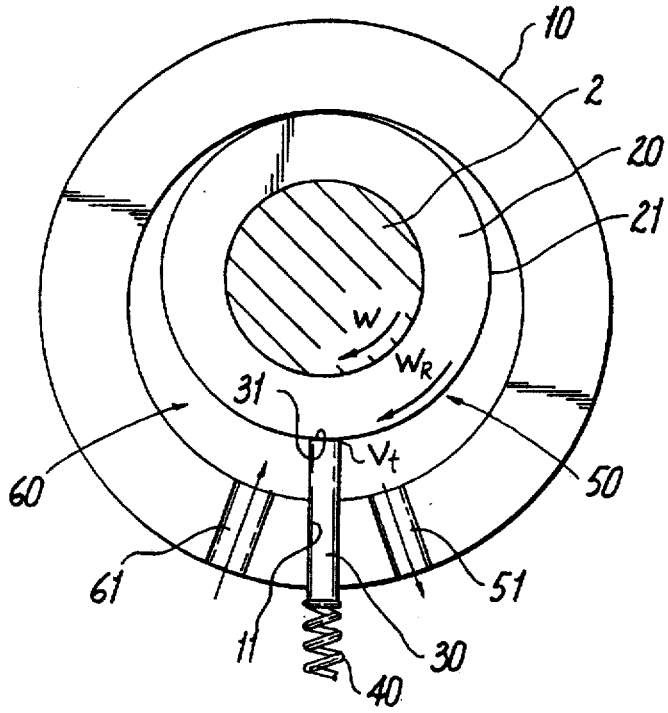
Fig. 2 (Prior Art)
FIG. 2 illustrates a partial sectional view, taken according to the line 2—2 of FIG. 1 and showing the piston-vane assembly, according to the prior art.

The lower part of the case 1 serves as a sump 7 for lubricant oil, which is necessary for the lubrication of the mechanical components of the compressor presenting relative movement to each other. As illustrated in FIG. 2, the fixed vane 30 defines inside the cylinder 10, around the piston 20 and between the internal faces of the main bearing 3 and secondary bearing 4, a compression chamber 50, having a discharge slot 51 communicating with the inside of the case 1 through an orifice provided at the secondary bearing 4, and a suction chamber 60, having a suction orifice 61, made through the secondary bearing 4, and to which a suction connector 62 is connected (FIG. 1). According to the prior art, during the operation of the compressor, the piston 20 presents a translational and rotational motion along the internal surface of the cylinder 10 that can be described as resulting from a translation made around the center of the cylinder and from a rotation around its own axis, the rotational speed (WR) of said piston 20 being determined by the drag caused by said eccentric shaft 2 rotating at a speed W and by the restrictions caused by the contact with the vane, cylinder and lateral wall of said piston 20. The rotational motion of said piston 20 results in a frictional contact between the latter and the vane free end 31, causing wear and power loss due to friction. Said wear is due to the relative speed (Vt) between the piston 20 and the vane free end 31. The frictional contact is due to the difficulty in maintaining an oil film between the contact surfaces, this being a function of the tangential contact between said surfaces, which is a consequence of the shape of the latter and of the relative motion between the piston 20 and the fixed vane 30.

According to the present invention, the reduction of wear at the vane free end 31 is obtained by increasing the contact area between a curved contact surface of the vane free end 31 and the lateral surface 21 of the piston 20 and by providing engaging means between the piston 20 and fixed vane 30, which practically eliminates the relative movement between said piston and vane, such as described below. Said engaging means causes a relative circumferential lock between said piston 20 and fixed vane 30, which prevents said piston 20 from rotating around its axis, but allows a relative movement between said piston and vane, resulting in the translational displacement of said piston 20 along the internal surface of the cylinder 10.

In this construction, the piston 20 presents no more the rotational motion around its axes of the prior art, caused by the rotation of the eccentric shaft 2, but an oscillating motion within the cylinder 10, around its point of engagement with said fixed vane 30, forced by the rotation of the eccentric shaft 2 and resulting in the translational motion cited above. Said oscillating motion occurs at a direction transverse to the axis of the cylinder 10, from one side to the other of the diametral plane, which is common to both the radial slot 21 and fixed vane 30. During said oscillation, when the piston 20 is close to the vane slot in the cylinder 10, its motion will predominantly be a rolling displacement. At the opposite portion, the motion will be a sliding displacement.

Figure 4:
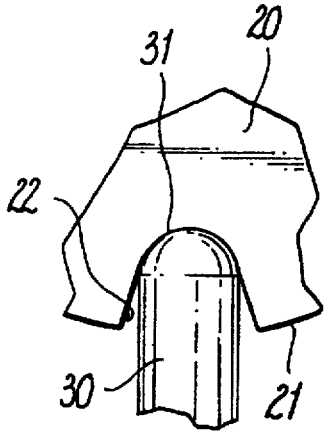
FIG. 4 is an enlarged view of the contact region between the fixed vane and the piston, according to one embodiment of the present invention.
Figure 3:
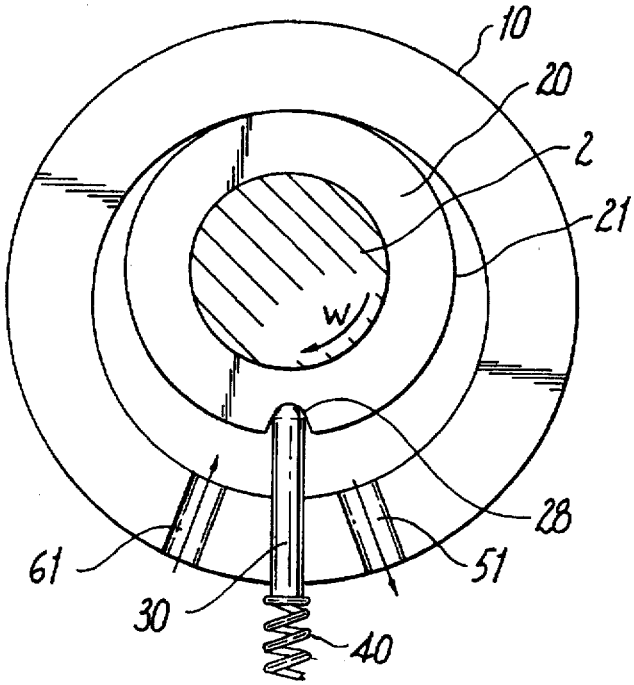
FIG. 3 illustrates a partial sectional view, similar to that of FIG. 2, but showing a fixed vane constructed according to the present invention and operating together with the piston.

In a way of carrying out the invention, such as illustrated in FIGS. 3 and 4, the piston-vane engaging means is defined as a retaining recess 22, provided along the axial extension of the piston 20, to which there is fitted at least a portion of the vane free end 31, whose contour presents a curvature that is substantially equal and concentric to the curvature of said retaining recess 22. In this construction, said retaining recess 22 has a concave profile, with a curvature similar to the convex profile of the contact end surface of the vane free end 31, in order to cover the whole width of said fixed vane 30, and has a circumferential extension at minimum equal to the corresponding circumferential extension of the vane free end 31.

Although not illustrated, the retaining recess 22 may present any polygonal cross section, as long as said retaining recess 22 presents its portion of contact with the vane free end 31 with a profile that is identical to that of the vane free end 31, in order to allow the maintenance of the oil film at this region during the movement of said piston 20. The circumferential extension of the retaining recess 22, independently of its cross section, should be larger than the circumferential extension of the vane free end 31, thereby allowing the piston 20 to effect the oscillating motion, during the development of the translational motion thereof and avoiding the disconnection of the assembly between said piston 20 and fixed vane 30 during said motion.

Though with a more complex construction, the vane free end 31, in another possible embodiment, may have at least part of its length provided with a concave retaining recess, receiving the corresponding projecting portion of the piston 20, said portion being either incorporated or mounted to the lateral surface 21 of said piston 20. Said constructions are designed in such a way as to maintain a non-tangential but continuous contact area along the axial length of the piston 20.

Figure 5:
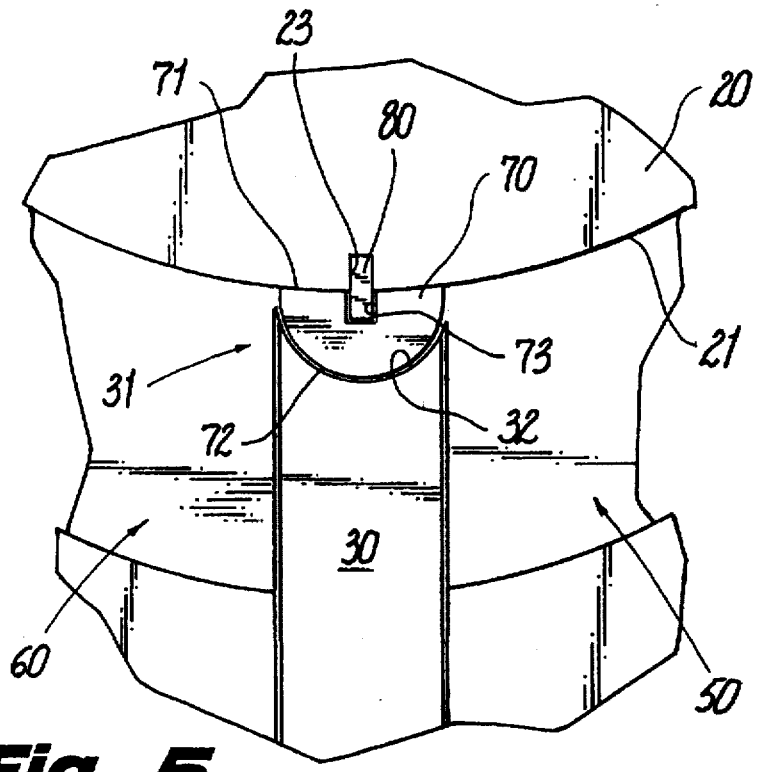
FIG. 5 is a similar view to that of FIG. 4, illustrating another embodiment of the present invention.

In the embodiment shown in FIG. 3 and 4, order to allow the oscillating motion of the piston 20 to both sides of the diametral plane of the radial slot 11, the retaining recess 22 has a circumferential extension larger than that of the vane free end 31, thereby generating lateral gaps in relation to the portion of mutual contact of both surfaces defined by said recess 22 and fixed vane 30, which avoids the disconnection between said fixed vane 30 and piston 20. In another embodiment of the invention illustrated in FIG. 5, the vane free end carrier on insert 70, such\ as described in the Brazilian Patent Application PI 9102901, which, in this construction presents a concave face 71, seated against the lateral surface 21 of the piston 20 and locked in this position by a locking means 80, described below, and which insert 70 further has a convex opposite face 72, whose surface having a curvature equal to that of the concave contact end surface of a retaining recess 32, which is provided at the vane free end 31 and which occupies the whole width and thickness of the fixed vane 30. Between the mutual contact surfaces of said insert 70 and the vane free end 31, there is maintained an oil film, which avoids the wearing friction between the parts presenting relative movement to each other.

In this construction, the circumferential locking of the piston 20 is obtained by retaining the insert 70 in the vane free end 31. The circumferential locking between the piston 20 and the insert 70 is achieved by a lock 80, in the form of a key, having an end portion lodged in a radial slot 23 provided in the piston 20 and an opposite end portion, lodged in a radial slot 73 provided at the contact face 71 of the insert 70, said slots being designed so as to occupy at least part of the axial extension of the piston 20 and said insert 70. In another non-illustrated embodiment, the lock 80 may have an end portion mounted to the piston 20 and an opposite end portion mounted to the vane free end 31.

Figure 6:
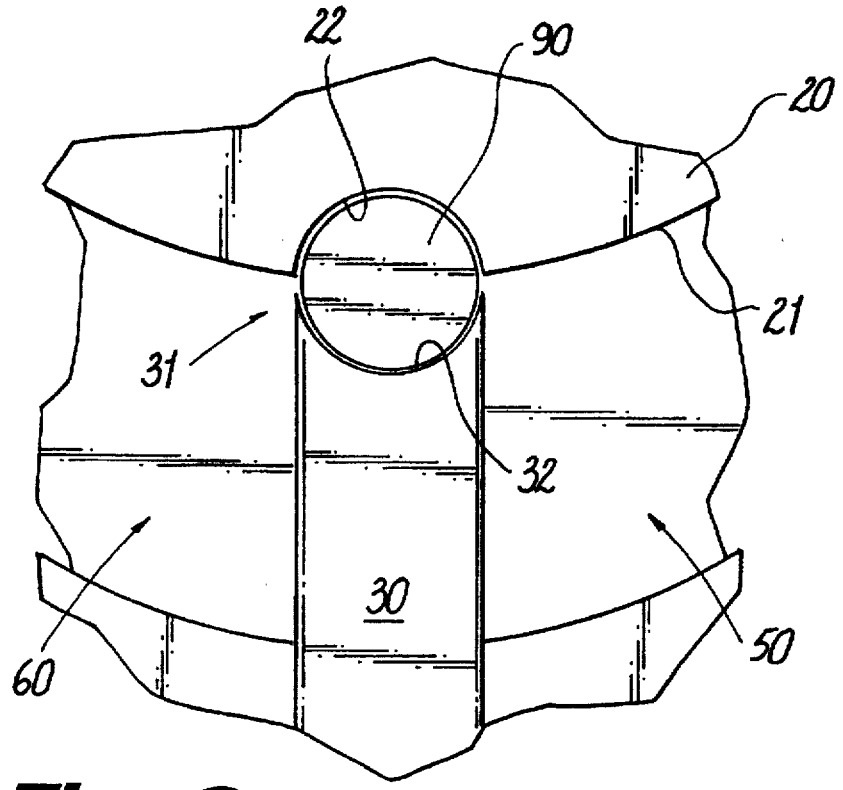
FIG. 6 is a similar view to that of FIG. 4, illustrating another embodiment of the present invention.

In another embodiment of the present invention illustrated in FIG. 6, the piston 20 and the fixed vane 30 present respective retaining recesses 22, 32, lodging a preferably cylindrical insert 90. Between said cylindrical insert 90 and the contact surface of each said retaining recess 22, 32, there is maintained an oil film that avoids the wearing friction and gas leakage between the suction chamber 50 and discharge chamber 60. In this construction, the insert 90 acts as a circumferential locking element between the piston 20 and fixed vane 30, in order to avoid the disconnection of said parts during the translational motion of said piston 20 along the internal surface of the cylinder 10.

In any of the embodiments presented, the increase of the contact area between the fixed vane 30 and the piston 20, associated with a relative oscillating motion thereof around the point of engagement with the vane free end 31, allows the maintenance of an oil film between said parts, resulting in a reduction in the wear of the vane free end 31 and the consequences of said wear.

With these constructions, only a contact portion of the circumferential extension of the lateral surface 21 of the piston 20 that operates with the vane free end 31 maintains contact with the piston during the translational motion of said piston along the internal surface of the cylinder 10.

In the embodiments presented, the relative movements in the direction longitudinal to the length of the fixed vane 30, between the engaging means and any of the parts involved, are avoided by the end walls of the cylinder 10, which are defined by the main bearing 3 and secondary bearing 4.

We claim:

1. A rotary compressor of the fixed vane type comprising:

a cylinder;

an eccentric piston within said cylinder rotated by a shaft;

a fixed vane in a radial slot in said cylinder extending toward said piston, said vane having a free end on which is seated an insert having a concave face which is in contact with the outer surface of the rotating piston; and engaging means located between said insert concave face and the outer face of said piston acting thereon to restrain said piston from rotating and to permit oscillation of said piston to both sides of a diametral plane through said radial slot and around the concave face of said insert during rotational motion of said piston, said engaging means causing circumferential locking of said piston relative to said insert.

2. A rotary compressor as in claim 1, wherein said engaging means comprises a lock mounted to said piston and said insert that acts simultaneously on said piston and said insert.

3. A rotary compressor as in claim 2, wherein said lock comprises a radial slot in said piston and a slot in the concave face of said insert, and a key lodged in said piston slot and said insert slot.

4. A rotary compressor as in claim 1 wherein the free end of said vane has a concave pocket and said insert has a convex face mounted in said vane concave pocket.

5. A rotary compressor as in claim 4, wherein said engaging means comprises a lock formed by a radial slot in said piston and a slot in the concave face of said insert, and a key lodged in said piston slot and said insert slot.

* * * * *